US008844384B2

(12) United States Patent
Oyama et al.

(10) Patent No.: US 8,844,384 B2
(45) Date of Patent: Sep. 30, 2014

(54) PRESSURE-SENSITIVE SENSOR PRODUCTION METHOD AND PRESSURE-SENSITIVE SENSOR

(75) Inventors: Hiroshi Oyama, Kawasaki (JP); Takashi Aoyama, Hitachi (JP); Akio Hattori, Hitachi (JP); Akira Yamaura, Hitachi (JP); Masashi Yoshio, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 300 days.

(21) Appl. No.: 13/292,969

(22) Filed: Nov. 9, 2011

(65) Prior Publication Data

US 2012/0111125 A1 May 10, 2012

(30) Foreign Application Priority Data

Nov. 10, 2010 (JP) ..... 2010-251952
Nov. 1, 2011 (JP) ..... 2011-240477

(51) Int. Cl.

| | |
|---|---|
| ***G01L 1/00*** | (2006.01) |
| ***G01L 5/04*** | (2006.01) |
| ***H01C 17/06*** | (2006.01) |
| ***H01C 17/28*** | (2006.01) |

(52) U.S. Cl.

CPC ..... *H01C 17/06* (2013.01); *H01C 17/28* (2013.01)

USPC ..... 73/862.68; 73/862.391; 73/862.473

(58) Field of Classification Search

None

See application file for complete search history.

(56) References Cited

U.S. PATENT DOCUMENTS

2001/0049964 A1* 12/2001 Ishihara et al. ..... 73/753

FOREIGN PATENT DOCUMENTS

| | | |
|---|---|---|
| JP | 11-237289 | 8/1999 |
| JP | 3354506 | 9/2002 |
| JP | 2003-162933 | 6/2003 |
| JP | 2004-220933 | 8/2004 |
| JP | 2005-302736 | 10/2005 |

* cited by examiner

*Primary Examiner* — Lisa Caputo
*Assistant Examiner* — Brandi N Hopkins
(74) *Attorney, Agent, or Firm* — Brundidge & Stanger, P.C.

(57) ABSTRACT

Two electrode wires longitudinally provided along the inner surface of an elastic insulating member having a hollow portion are exposed from said elastic insulating member, the resistive element comprising a resistor body and the resistive element's lead wires is formed into a U-letter shape, said two electrode wires exposed from said elastic insulating member and said resistive element's lead wires are electrically connected via one metal plate, and a portion wherein one of said two electrode wires and one of the lead wires extending from both ends of said resistor body are electrically connected and a portion wherein the other one of said two electrode wires and the other one of the lead wires extending from both ends of said resistor body are electrically connected are separated by cutting said one metal plate.

20 Claims, 11 Drawing Sheets

(a)

(b)

(a)

(b)

(c)

PRESSURE-SENSITIVE SENSOR PRODUCTION METHOD AND PRESSURE-SENSITIVE SENSOR

CROSS REFERENCE TO RELATED APPLICATIONS

This application claims priority to Japanese Patent Application Nos. 2010-251952 and 2011-240477 filed on Nov. 10, 2010 and Nov. 1, 2011, respectively, the entire contents of which are incorporated herein by reference.

TECHNICAL FIELD

The present invention relates to a pressure-sensitive sensor production method and a pressure-sensitive sensor.

BACKGROUND ART

Conventionally, a device commonly used as a pressure-sensitive sensor is constructed such that four electrode wires are circumferentially disposed on the surface of the inner circumference of a restorable hollow insulator at predetermined intervals where respective electrode wires are longitudinally disposed in a spiral manner (for example, see Japanese Patent No. 3354506 (patent literature 1)). The pressure-sensitive sensor described in patent literature 1 is constructed such that a pair of electrode wires (two wires) of the above four electrode wires is connected to a resistive element via a support member on the base end side of the pressure-sensitive sensor. Due to this configuration, electric current which was flowing through the resistive element in a state where a pressing force was not applied to the pressure-sensitive sensor flows without passing through the resistive element once a pressing force is applied to the pressure-sensitive sensor and at least two electrode wires out of four electrode wires contact one another (short circuit). The pressure-sensitive sensor described in patent literature 1 is capable of sensing the presence or absence of a pressing force by sensing the presence or absence of a resistance value of the resistive element.

However, recently, as the mounting portion of the pressure-sensitive sensor becomes small, it is required that the pressure-sensitive sensor becomes further smaller. Moreover, as with other sensors, cost reduction has been required with regard to the pressure-sensitive sensor.

To meet such requirements, it has been proposed that the outer diameter of the pressure-sensitive sensor itself be made small by reducing the number of electrode wires from four to two to make the sensor compact and also a further reduction of cost be attempted by reducing the amount of electrode wires to be used (for example, see published unexamined Japanese Patent Laid-open No. 2005-302736 (patent literature 2)).

In the pressure-sensitive sensor having two electrode wires described in patent literature 2, it is preferable that a resistive element be connected to the tip of the electrode wires so as to effectively exert the sensor function in its longitudinal direction. However, since the portion to which the resistive element has been mounted is not sensitive to a pressing force (hereafter, the portion which is not sensitive to the pressing force is referred to as "non-pressure-sensitive portion"), it is necessary to reduce the size of the non-pressure-sensitive portion by as much as possible so as to effectively utilize the function throughout the pressure-sensitive sensor including its end portion. This means that the resistive element needs to be mounted to an area that is as small as possible. Connecting the electrode wires at the tip portion to the lead wires of the resistive element by the use of the support member described in patent literature 1 can be considered; however, since the above-mentioned support member itself is wide and long, the size of the non-pressure-sensitive portion of the pressure-sensitive sensor increases. For this reason, it is desirable that the electrode wires and the lead wires of the resistive element be directly connected without providing a support member.

A possible connection method is, for example, one that uses ultrasonic vibration, which is described in published unexamined Japanese Patent Laid-open No. 2004-220933 (patent literature 3). In the connection method described in patent literature 3, a plurality of electric wires are disposed between an ultrasonic horn and an anvil, and a compression force and an ultrasonic vibration are applied to the plurality of electric wires thereby welding together the plurality of electric wires.

Furthermore, another possible connection method is, for example, one that uses resistance welding, which is described in published unexamined Japanese Patent Laid-open No. 2003-162933 (patent literature 4). In the connection method described in patent literature 4, the electrode wires of the pressure-sensitive sensor and the in-car side cable are connected by the resistance welding via a wiring pattern created on the insulating base.

However, when the connection method described in patent literature 3 is used, there is a problem in that it is not easy to produce a pressure-sensitive sensor having two electrode wires. That is, the connection method described in patent literature 3 is a method in which a groove is formed in a predetermined position of an anvil, and a plurality of electric wires is inserted into the inside of the groove to make connections. In this method, when two electrode wires are disposed very close to each other so as to prevent the increase in the size of the pressure-sensitive sensor, the side wall of the anvil becomes an obstacle, which makes it difficult to connect the electrode wires and the resistive element. Due to this, there was a problem in that it is not easy to produce a pressure-sensitive sensor having two electrode wires.

Furthermore, when the connection method described in patent literature 4 is used, there is a problem in that the size of the non-pressure-sensitive portion of the pressure-sensitive sensor having two electrode wires increases. This means that in the connection method described in patent literature 4 it is necessary to appose a pair of positive and negative electrodes for resistance welding on the wiring pattern at the time of resistance welding. This requires a space where positive and negative electrodes can be disposed on the wiring pattern; therefore, it is inevitably necessary to make the wiring pattern large. Consequently, when the connection method described in patent literature 4 is applied to the pressure-sensitive sensor having two electrode wires, there is a problem that the size of the non-pressure-sensitive portion increases.

In light of the above circumstances, an objective of the present invention is to provide a pressure-sensitive sensor production method and a pressure-sensitive sensor that has two electrode wires to contribute to reducing costs and the size and is capable of preventing the increase in the size of the non-pressure-sensitive portion and achieving easy production.

SUMMARY OF THE INVENTION

The present invention is a pressure-sensitive sensor production method, comprising: exposing two electrode wires longitudinally provided along the inner surface of an elastic insulating member having a hollow portion; forming a resistive element into a U-letter shape, the resistive element comprising a resistor body and lead wires extending from both ends of the resistor body; electrically connecting the two electrode wires exposed from the elastic insulating member and the lead wires extending from both ends of the resistor body via one metal plate; and separating a portion where one of the two electrode wires and one of the lead wires extending from both ends of the resistor body are electrically connected via the metal plate and a portion where the other of the two electrode wires and the other of the lead wires extending from both ends of the resistor body are electrically connected via the metal plate by cutting one metal plate.

Furthermore, the present invention is a pressure-sensitive sensor comprising an elastic insulating member having a hollow portion, two electrode wires longitudinally provided along the inner surface of the elastic insulating member, two metal terminals to which the two electrode wires are connected respectively; the two metal terminals separated from each other spatially, and a resistive element having a resistor body and lead wires extending from both ends of the resistor body and connected to the two metal terminals respectively; the resistive element being formed into a U-letter shape.

Effects of the Invention

According to the present invention, it is possible to provide a pressure-sensitive sensor production method and a pressure-sensitive sensor that has two electrode wires to contribute to reducing costs and the size and is capable of preventing the increase in the size of the non-pressure-sensitive portion and achieving easy production.

BRIEF DESCRIPTION OF DRAWINGS

FIG. 8(*a*) and FIG. 8(*b*) are cross-sectional views showing the process before the process in which the connecting portions A and B are separated and showing the process after the process in which the connecting portions A and B have been separated, respectively.

BEST MODE FOR CARRYING OUT THE INVENTION

Hereafter, embodiments of the present invention will be described in detail with reference to the attached drawings.

Figure 1:
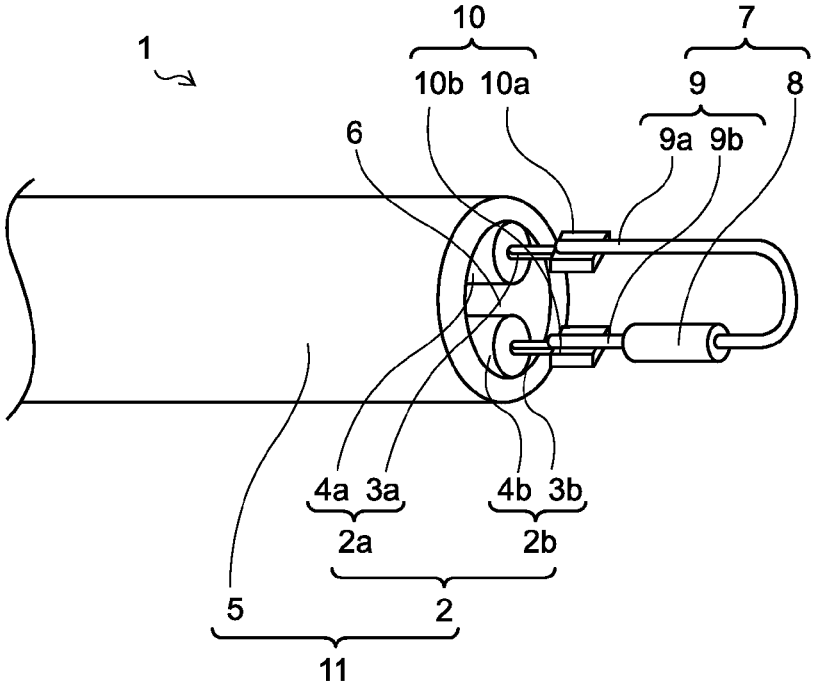
FIG. 1 is a perspective view of the connecting portion of the resistive element of the pressure-sensitive sensor 1 according to an embodiment of the present invention.
Figure 2:
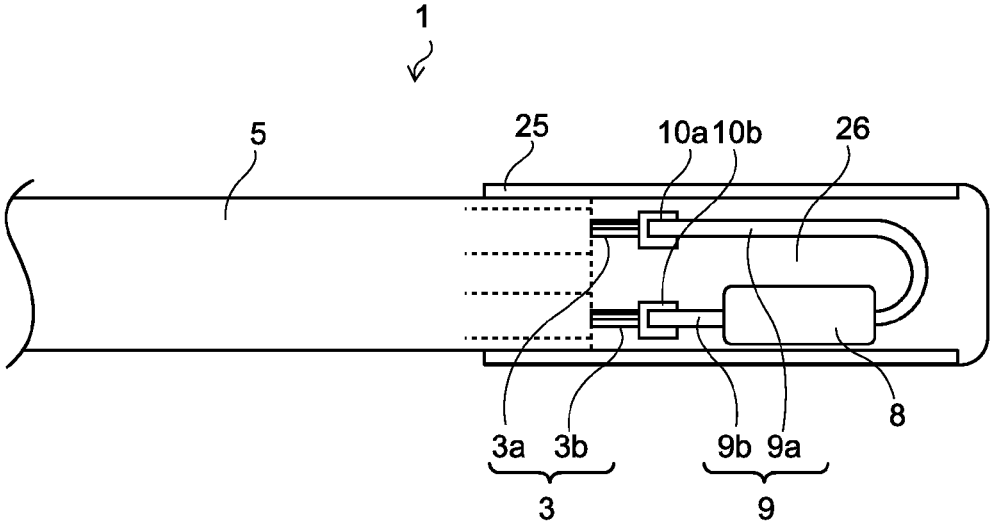
FIG. 2 is a longitudinal sectional view of the terminal portion of the pressure-sensitive sensor 1 according to an embodiment of the present invention.
Figure 3:
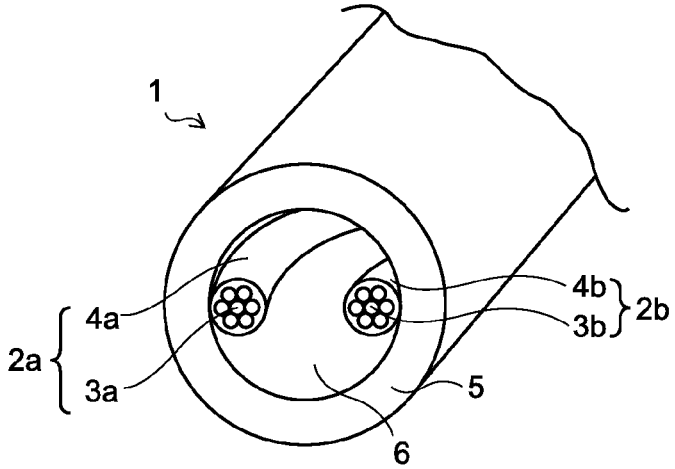
FIG. 3 is a cross-sectional view of the cable 11 for the pressure-sensitive sensor used for the pressure-sensitive sensor 1 according to an embodiment of the present invention.

FIG. 1 is a perspective view of the connecting portion of the resistive element of a pressure-sensitive sensor 1 according to an embodiment of the present invention. FIG. 2 is a longitudinal sectional view of the terminal portion of the pressure-sensitive sensor 1 according to an embodiment of the present invention. FIG. 3 is a cross-sectional view of the cable 11 for the pressure-sensitive sensor used for the pressure-sensitive sensor 1 according to an embodiment of the present invention.

1. A Pressure-Sensitive Sensor 1 According to an Embodiment of the Present Invention. (1) Configuration of the Pressure-Sensitive Sensor 1 According to an Embodiment of the Present Invention.

The pressure-sensitive sensor 1 according to an embodiment of the present invention is, for example, installed in the end portion of the closing-side electrical sliding door that is closed when the electrical sliding door of the vehicle is closed, and is intended to sense pressure when a human body or an object comes in contact with the door. As shown in FIG. 1 and FIG. 2, the pressure-sensitive sensor 1 according to an embodiment of the present invention comprises an elastic insulating member 5 having a hollow portion 6; two electrode wires 2*a* and 2*b* provided longitudinally along the inner surface of the elastic insulating member 5; two metal terminals

10*a* and 10*b* that have been spatially separated and to which two electrode wires 2*a* and 2*b* are connected, respectively; and a U-letter shaped resistive element 7 having a resistor body 8, and lead wires 9*a* and 9*b* extending from both ends of the resistor body 8 and connected to the two metal terminals 10*a* and 10*b*, respectively. That is, the pressure-sensitive sensor 1 according to an embodiment of the present invention is constructed such that the electrode wires 2*a* and 2*b* and the lead wires 9*a* and 9*b* of the resistive element 7 are connected together via metal terminals 10*a* and 10*b*.

The elastic insulating member 5 is composed of a cylindrical insulative elastic body extending in a longitudinal direction. Specifically, the elastic insulating member 5 is composed of an insulative elastic body having a diameter of 3.0 mm and a length of 1.5 m, where a cylindrical hollow portion 6 having a diameter of 2.0 mm and a length of 1.5 m has been formed. As an elastic body constituting the elastic insulating member 5, this embodiment uses an ethylene-propylene rubber (EP rubber); however, other than this, rubber materials such as silicone rubber, styrene-butadiene rubber and chloroprene rubber, or polyethylene, ethylene-vinyl acetate copolymer, ethylene methyl methacrylate copolymer, polyvinyl chloride, olefin or styrene thermoplastic elastomer, or the like, can be used. Herein, dimensions of the elastic insulating member 5 in this embodiment are as described above; however, an elastic insulating member having a diameter of between 3.0 and 5.0 mm and a length of between 1.0 and 2.0 m provided with a hollow portion having a diameter of between 2.0 and 3.0 mm can be used.

Although an ordinary pressure-sensitive sensor uses four electrode wires 2, the present invention is to use two electrode wires (electrode wire 2*a* and electrode wire 2*b*) to contribute to reducing costs and the size. In this embodiment, the electrode wires 2*a* and 2*b* are composed of twisted copper wires 3*a* and 3*b* and conductive rubbers 4*a* and 4*b* covering the outer circumference of the twisted copper wires 3*a* and 3*b*. The electrode wires 2*a* and 2*b* are provided longitudinally in a double-helical manner along the inner surface of the elastic insulating member 5. The reason why the electrode wires 2*a* and 2*b* are provided in a double-helical manner is to prevent the electrode wires from buckling, for example, when the pressure-sensitive sensor is installed in the curved portion of a vehicle body and accordingly to prevent the electrode wires from short-circuiting each other causing malfunctions when an external pressure has not been applied. Furthermore, by forming the electrode wires 2*a* and 2*b* together in a double-helical manner, it is possible for the pressure-sensitive sensor 1 to longitudinally sense pressure applied from all directions.

The respective twisted copper wires 3*a* and 3*b* are formed by twisting a plurality of tinned soft copper wires each having a diameter of 0.1 mm or less so that the diameter of the respective twisted copper wires 3*a* and 3*b* becomes nearly 0.7 mm.

Insulating rubber blended with copper, conductive carbon, or the like, for example, is used as the conductive rubbers 4*a* and 4*b*. Since the conductive rubbers 4*a* and 4*b* cover the outer circumference of the respective twisted copper wires 3*a* and 3*b* with a thickness of 0.2 mm, the diameter of the respective electrode wires 2*a* and 2*b* is set at 1.1 mm. By covering the outer circumference of the twisted copper wires 3*a* and 3*b* with the respective conductive rubbers 4*a* and 4*b*, there is an advantage that adhesiveness between the electrode wires 2*a* and 2*b* and the elastic insulating member 5 can be increased. In this case, the adhesiveness can be further increased by using the same insulating rubber material for both the conductive rubbers 4*a* and 4*b* and the elastic insulating member 5.

Furthermore, in this embodiment, as shown in FIG. 1, electrode wires 2*a* and 2*b* are connected to metal terminals 10*a* and 10*b* via the exposed internal twisted copper wires 3*a* and 3*b* which have removed the conductive rubbers 4*a* and 4*b* in the end portion thereof which connect to the respective metal terminals 10*a* and 10*b*.

The resistive element 7 comprises a resistor body 8 and lead wires 9*a* and 9*b* extending from both ends of the resistor body 8. A carbon-film resistor (resistance value: 1 kΩ) having a diameter of 1.7 mm and a length of 3.2 mm is used as the resistor body 8. The resistive element 7 is formed into a U-letter shape (referred to as U forming or radial forming) so that it can be applied even when the diameter of the cable 11 for the pressure-sensitive sensor is very small (diameter: 3.0 mm) as shown in this embodiment and so as to prevent the resistive element 7 from being cut during the separation process (process 5) in the method of producing the pressure-sensitive sensor 1 which will be described later. Herein, as shown in FIG. 3, the cable 11 for the pressure-sensitive sensor is meant to be a cable composed of electrode wires 2*a* and 2*b* and an elastic insulating member 5 and to which the resistive element 7 has not been connected. Tinned soft copper wires each having a diameter of 0.45 mm are used as the lead wires 9*a* and 9*b*. The lead wires 9*a* and 9*b* extending from both ends of the resistor body 8 are connected to other metal terminals 10*a* and 10*b*, respectively.

The metal terminals 10*a* and 10*b* are composed of a copper alloy, such as phosphor bronze, brass, or the like, and the surface thereof is, for example, tinned so as to facilitate the welding to the twisted copper wires 3*a* and 3*b* and the lead wires 9*a* and 9*b*. The internal twisted copper wires 3*a* and 3*b* exposed by removing the conductive rubbers 4*a* and 4*b* from the electrode wires 2*a* and 2*b* are electrically connected to the lead wires 9*a* and 9*b* via the metal terminals 10*a* and 10*b*, respectively. Although in this embodiment, the metal terminals 10*a* and 10*b* are composed of a copper alloy or the like, material of the metal terminals 10*a* and 10*b* can be any other metal as long as the metal terminals 10*a* and 10*b* can be electrically connected to the twisted copper wires 3*a* and 3*b* and the lead wires 9*a* and 9*b* in an excellent condition. Furthermore, it is preferable that the sum of the width of the two metal terminals 10*a* and 10*b* (the length of the metal terminals 10*a* and 10*b* in the direction of the diameter of the cable 11 for the pressure-sensitive sensor) be smaller than the diameter of the cable 11 for the pressure-sensitive sensor. This is to reduce an opportunity of electrical conduction in the connecting portion of two electrode wires 2 and also to prevent the non-pressure-sensitive portion of the pressure-sensitive sensor 1 from becoming large. Furthermore, the length of the metal terminals 10*a* and 10*b* (the length of the metal terminals 10*a* and 10*b* in the longitudinal direction of the cable 11 for the pressure-sensitive sensor (the horizontal length in FIG. 1)) should be between 0.3 and 10 mm although the length is adjusted according to the shape of a jig or the like, used in the welding method to connect together the twisted copper wires 3*a* and 3*b* and the lead wires 9*a* and 9*b*. Moreover, in terms of miniaturization of the pressure-sensitive sensor, it is preferable that interval between the lead wires 9*a* and 9*b* be between 1 and 3 mm.

As an example of the connection between the twisted copper wires 3*a* and 3*b* and the lead wires 9*a* and 9*b* via metal terminals 10*a* and 10*b*, in this embodiment, as shown in FIG. 1 and FIG. 2, the lead wires 9*a* and 9*b* are connected to the other surface (bottom surface in FIG. 1 and FIG. 2) of the surface of the metal terminals 10*a* and 10*b* (top surface in FIG. 1 and FIG. 2) to which the twisted copper wires 3*a* and 3*b* are connected. The length from the end portion of the elastic insulating member 5 to the end portion of the resistive element 7, that means the length from the end portion of the elastic insulating member 5 to the end portion of the lead wires 9*a* and 9*b* should be 10 mm or less.

Moreover, the terminal portion of the pressure-sensitive sensor 1 according to this embodiment shown in FIG. 1 wherein the twisted copper wires 3*a* and 3*b* and the lead wires 9*a* and 9*b* are connected together via the metal terminals 10*a* and 10*b* needs to be sealed to prevent material deterioration and malfunctions caused by moisture seeping into the inside. To do so, the terminal portion of the pressure-sensitive sensor 1 is wrapped around with a transparent resin sleeve 25 as shown in FIG. 2 and sealed by injecting insulating resin 26 through the opening of the sleeve 25. In this embodiment, as an insulating resin 26, for example, ultraviolet curable insulating resin can be used. The ultraviolet curable insulating resin cures in a short amount of time by the light transmitting the transparent sleeve 25. In this embodiment, not only ultraviolet curable insulating resin, but also thermoplastic synthetic resin which becomes liquid or gelled fluid by being heated, or insulating material such as rubber material, can be used. Furthermore, room temperature curing insulating resin or thermosetting insulating resin that proceeds with the curing reaction at a temperature of 150° C. or lower can be used. Moreover, the sleeve 25 shown in FIG. 2 may be transparent or opaque. Furthermore, when conducting the sealing by the use of the above-mentioned insulating material, it is possible to adopt a method that uses a plastic, glass or metal die for molding instead of using the sleeve 25 shown in FIG. 2.

(2) Operation of the Pressure-Sensitive Sensor 1 According to an Embodiment of the Present Invention.

Figure 4:
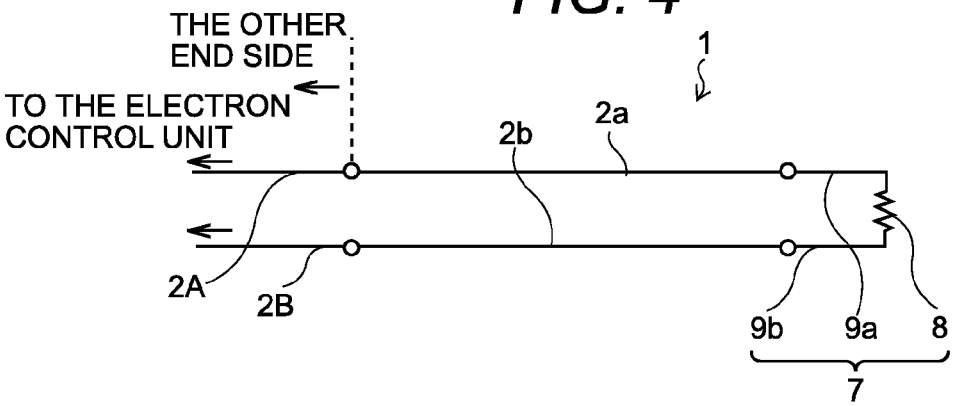
FIG. 4 is a drawing showing a connection circuit of the pressure-sensitive sensor 1 according to an embodiment of the present invention.

Operation of the pressure-sensitive sensor 1 according to an embodiment of the present invention will be described with reference to FIG. 4. FIG. 4 is a drawing showing a connection circuit of the pressure-sensitive sensor 1 according to an embodiment of the present invention.

The other end of the pressure-sensitive sensor 1 to which the resistive element 7 is not connected is connected to an electronic control unit (not shown) via connecting wires 2A and 2B. When pressure is not applied to the pressure-sensitive sensor 1, the resistance value of the resistor body 8 is measured because electric current flows through the resistor body 8 of the resistive element 7 connected to the tip of the cable 11 for the pressure-sensitive sensor. However, when a pressure is applied to the pressure-sensitive sensor 1 due to the contact of a human body or an object, the resistance value of the resistor body 8 is not measured because the pressure causes the internal electrode wires 2*a* and 2*b* to contact one another (short-circuit), thereby the electric current flows without passing through the resistor body 8. The pressure-sensitive sensor 1 senses a pressure by detecting the presence or absence of measurement of the resistance value of the resistor body 8. Thus, the pressure-sensitive sensor 1 according to the present invention exerts the function to sense pressure.

Furthermore, if a strong impact is applied to the pressure-sensitive sensor 1 or a sharp-edged object is stuck in the pressure-sensitive sensor 1, one of or both of the electrode wires 2*a* and 2*b* may be broken. In this case, the connection circuit is left open and the resistance value of the resistor body 8 is not measured; accordingly, it is recognized that disconnection has occurred somewhere in the electrode wires 2*a* and 2*b*.

That is, the resistor body 8 has a function that contributes to sensing pressure and a function that contributes to recognizing a disconnection of the electrode wires 2*a* and 2*b*.

(3) Variation of the Pressure-Sensitive Sensor 1.

The pressure-sensitive sensor 1 according to the present invention is not limited to the above embodiment, and variations can be made as described below.

The electrode wires 2*a* and 2*b* are composed of the twisted copper wires 3*a* and 3*b* and the conductive rubbers 4*a* and 4*b* that cover the outer circumference of the respective twisted copper wires 3*a* and 3*b*; however, the electrode wires 2*a* and 2*b* may be composed of twisted copper wires 3*a* and 3*b* alone or conductive rubbers 4*a* and 4*b* alone.

In FIG. 1 and FIG. 2, the twisted copper wires 3*a* and 3*b* are connected to the top surface of the metal terminals 10*a* and 10*b*, and the lead wires 9*a* and 9*b* are connected to the bottom surface of the metal terminals 10*a* and 10*b*; however, the twisted copper wires 3*a* and 3*b* and the lead wires 9*a* and 9*b* may be connected only to the top surface (or bottom surface) of the metal terminals 10*a* and 10*b*.

Figure 5:
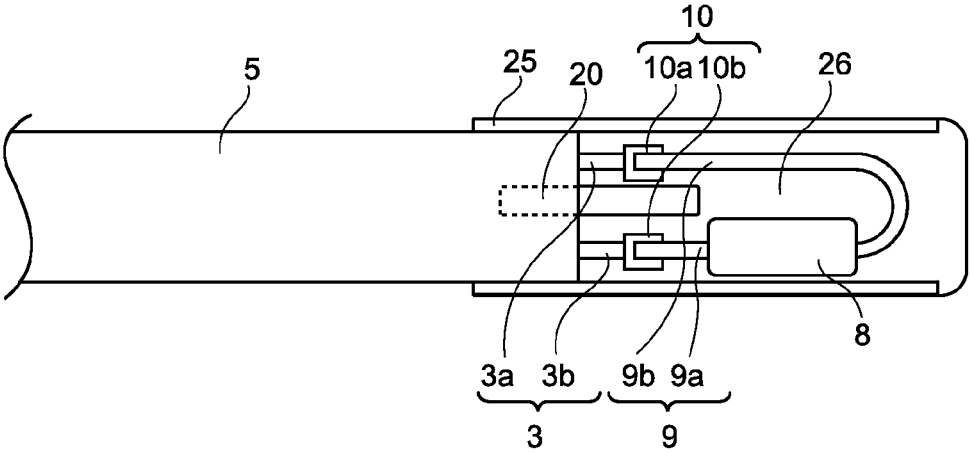
FIG. 5 is a longitudinal sectional view of the terminal portion of the pressure-sensitive sensor 1 according to an embodiment of the present invention that is provided with an insulating spacer 20.

It is possible to provide an insulating spacer 20 between the metal terminal 10*a* and the metal terminal 10*b* so as to prevent the metal terminal 10*a* and the metal terminal 10*b* from coming in contact with each other (short-circuiting). FIG. 5 shows a pressure-sensitive sensor in which an insulating spacer 20 is provided between the metal terminal 10*a* and the metal terminal 10*b* by inserting the insulating spacer 20 into the end portion of the cable 11 for the pressure-sensitive sensor. In this configuration, it is also possible to provide a groove (not shown) for the insertion of the insulating spacer 20 internally in the end portion of the elastic insulating member 5. Thus, by providing an insulating spacer 20 between the metal terminal 10*a* and the metal terminal 10*b* to prevent the metal terminal 10*a* and the metal terminal 10*b* from coming in contact with each other (short-circuiting), it is possible to suppress fluctuation of the resistance value at normal time by as much as possible and eliminate environmental impacts, such as vibration, moisture, temperature change, and the like; consequently, reliability can be increased.

2. A Method of Producing a Pressure-Sensitive Sensor 1 According to an Embodiment of the Present Invention.

A method of producing the above-mentioned pressure-sensitive sensor 1 according to an embodiment of the present invention will be described in detail with reference to the attached drawings.

A method of producing a pressure-sensitive sensor 1 according to an embodiment of the present invention comprises, as shown in FIGS. 6 to 20: exposing two electrode wires 2*a* and 2*b* longitudinally provided along the inner surface of an elastic insulating member 5 having a hollow portion 6; forming a resistive element 7 into a U-letter shape, the resistive element 7 comprising a resistor body 8 and lead wires 9*a* and 9*b* extending from both ends of the resistor body 8; electrically connecting the two electrode wires 2*a* and 2*b* exposed from the elastic insulating member 5 and the lead wires 9*a* and 9*b* extending from both ends of the resistor body 8 via one metal plate 14; and separating a portion where one electrode wire 2*a* out of the two electrode wires 2*a* and 2*b* and one lead wire 9*a* out of the lead wires 9*a* and 9*b* extending from both ends of the resistor body 8 are electrically connected via the metal plate 15 (hereafter, referred to as connecting portion A) and a portion where the other electrode wire 2*b* out of the two electrode wires 2*a* and 2*b* and the other lead wire 9*b* out of the lead wires 9*a* and 9*b* extending from both ends of the resistor body 8 are electrically connected via the metal plate 14 (hereafter, referred to as connecting portion B) by cutting one metal plate 14.

Hereafter, embodiments of a method of producing the above-mentioned pressure-sensitive sensor 1 will be described with regard to two situations: a situation in which resistance welding is applied (embodiment 1) and a situation in which laser welding is applied (embodiment 2).

Embodiment 1

A Method of Producing the Pressure-Sensitive Sensor 1 Wherein Resistance Welding is Used <Production Processes of the Method of Producing the Pressure-Sensitive Sensor 1 According to Embodiment 1>

Hereafter, the method of producing the pressure-sensitive sensor 1 according to embodiment 1 wherein resistance welding is used will be described for each process with reference to FIGS. 2, and 6 to 11. Herein, description will be mainly given about a method of producing a pressure-sensitive sensor 1 in which two twisted copper wires 3*a* and 3*b* are connected to one surface (top surface) of a metal plate 14, and lead wires 9*a* and 9*b* extending from both ends of the resistor body 8 are connected to the other surface (bottom surface).

(Process 1: Process for Exposing Twisted Copper Wires)

First, process 1 for exposing twisted copper wires 3*a* and 3*b* will be described.

An elastic insulating member 5 of the cable 11 for the pressure-sensitive sensor is cut at a predetermined position (the position near the tip portion), and the tip side of the elastic insulating member 5 alone is removed, thereby two electrode wires 2*a* and 2*b* are exposed. After two electrode wires 2*a* and 2*b* have been exposed from the tip portion of the elastic insulating member 5, a predetermined length of the conductive rubbers 4*a* and 4*b* located on the tip side of the respective electrode wires 2*a* and 2*b* is removed, thereby the twisted copper wires 3 are exposed from the conductive rubber 4. In this embodiment, the entire conductive rubber 4 exposed from the elastic insulating member 5 has been removed.

(Process 2: Process for Forming a Resistive Element into a U-Letter Shape)

Next, process 2 for forming a resistive element 7 into a U-letter shape will be described.

The resistive element 7 is formed into a U-letter shape (referred to as U-letter forming or radial forming) so that it can be applied even when the diameter of the cable 11 for the pressure-sensitive sensor used for the pressure-sensitive sensor 1 according to this embodiment is very small. At this point, the resistive element 7 is formed into a U-letter shape by bending the lead wire 9*a* extending from the other end of the resistor body 8 so that the resistor body 8 and the lead wire 9*b* extending from one end of the resistor body 8 are almost parallel to a part of the lead wire 9*a* extending from the other end of the resistor body 8. Herein, almost parallel does not intend to mean perfectly parallel alone, but intends to include the situation in which the resistor body 8 and the lead wire 9*b* extending from one end of the resistor body 8 are slightly slanted with regard to the part of the lead wire 9*a* extending from the other end of the resistor body 8. That is, the "U-letter shape" herein intends to include such a shape as a "V-letter shape".

(Process 3: Process for Connecting Twisted Copper Wires)

Next, process 3 for connecting twisted copper wires 3*a* and 3*b* to a metal plate 14 will be described with reference to FIG. 6.

First, one twisted copper wire 3*a* out of two twisted copper wires 3*a* and 3*b* of the cable 11 for the pressure-sensitive sensor is disposed on one surface (top surface) of one metal plate 14. Then, as shown in FIG. 6(*a*), the twisted copper wire 3*a* and the metal plate 14 are vertically sandwiched between two electrodes 100 for resistance welding and electric current is applied to the twisted copper wire 3*a* and the metal plate 14. At this point, by generating Joule heat on the metal plate 14 which is a welding target base and the twisted copper wire 3*a* due to electric current running from the electrodes 100 and melting tin that has been plated on the metal plate 14 and the twisted copper wire 3*a* and simultaneously applying a pressing force vertically by the two electrodes 100, the twisted copper wire 3*a* and the metal plate 14 are welded together to make a connection. In this embodiment, resistance welding was conducted by the use of electrodes 100 each having a circular cross-section with a diameter of 6.0 mm, with a pressure of 98 N, and the current-carrying condition of 2.2 kA, 10 ms. Then, the same resistance welding is applied to the other twisted copper wire 3*b*. Eventually in this process, a configuration is formed wherein two twisted copper wires 3*a* and 3*b* of the cable 11 for the pressure-sensitive sensor are connected to one surface (top surface) of one metal plate 14.

The surface of the metal plate 14 used in this embodiment has been tinned so that the metal plate 14 can be easily welded to the twisted copper wires 3*a* and 3*b* and the lead wires 9 when resistance welding is conducted. Furthermore, the metal plate 14 used in this embodiment is rectangular. However, the shape of the metal plate 14 is not limited to a rectangle, and a circular or elliptical metal plate 14 can also be used.

Moreover, in this process, it is preferable that when conducting resistance welding, the twisted copper wires 3 be welded while tension (tensile force) is being applied. By doing so, it is possible to conduct welding while preventing the twisted copper wires 2 from scattering. Furthermore, in this process, resistance welding is conducted while the twisted copper wire 3*a* and the metal plate 14 are vertically sandwiched between the two electrodes; however, for example, as shown in FIG. 6(*b*), it is possible to conduct resistance welding while one electrode 100 is made to come in contact with the twisted copper wire 3*a*, and the other electrode 100 is apposed to the electrode 100 in the direction of the width of the metal plate 14 (horizontal direction in FIG. 6(*b*)) and made to come in contact with the metal plate 14.

(Process 4: Process for Connecting the Resistive Element's Lead Wires)

Next, process 4 for connecting lead wires 9*a* and 9*b* to a metal plate 14 will be described with reference to FIG. 7.

First, two twisted copper wires 3*a* and 3*b* of the cable 11 for the pressure-sensitive sensor are connected to one surface (top surface) of one metal plate 14 and then rotated in the direction of the circumference of the cable 11 for the pressure-sensitive sensor, thereby the other surface (bottom surface) of the metal plate 14 is placed face up. Then, lead wires 9*a* and 9*b* extending from both ends of the resistor body 8 are disposed on the bottom surface of the metal plate 14. At this point, it is preferable that the lead wires 9*a* and 9*b* be disposed at locations where the median line of the width of the lead wires 9*a* and 9*b* (the horizontal length in FIG. 7(*b*)) almost matches the median line of the width of the twisted copper wires 3*a* and 3*b* (the horizontal length in FIG. 7(*b*)). By doing so, the width of connecting portions A and B can be minimized, thereby making it possible to prevent the tip portion of the pressure-sensitive sensor 1 from becoming large. Moreover, in this embodiment, since the width of the lead wires 9*a* and 9*b* is greater than the width of the twisted copper wires 3*a* and 3*b*, as shown in FIG. 7(*b*), the width of the lead wires 9*a* and 9*b* is the width of the connecting portions A and B. Furthermore, it is preferable that the interval between the portion at which one twisted copper wire 3*a* out of two twisted copper wires 3*a* and 3*b* and one lead wire 9*a* out of lead wires 9*a* and 9*b* extending from both ends of the resistor body 8 are electrically connected together via the metal plate 14 and the portion at which the other twisted copper wire 3*b* out of two twisted copper wires 3*a* and 3*b* and the other lead wire 9*b* out of lead wires 9*a* and 9*b* extending from both ends of the resistor body 8 are electrically connected together via the metal plate 14 be between 1 and 3 mm. That is, as shown in FIG. 7, it is preferable that interval D between connecting portion A and connecting portion B be between 1 and 3 mm. By doing so, the width of non-pressure-sensitive portion (the length of the non-pressure-sensitive portion in the direction of the diameter in the cross section of pressure-sensitive sensor 1) can be inhibited its increase, and it becomes easy to dispose an insulating spacer 20, separation process, which will be described later, and resinate the end portion of the pressure-sensitive sensor 1.

Figure 7:
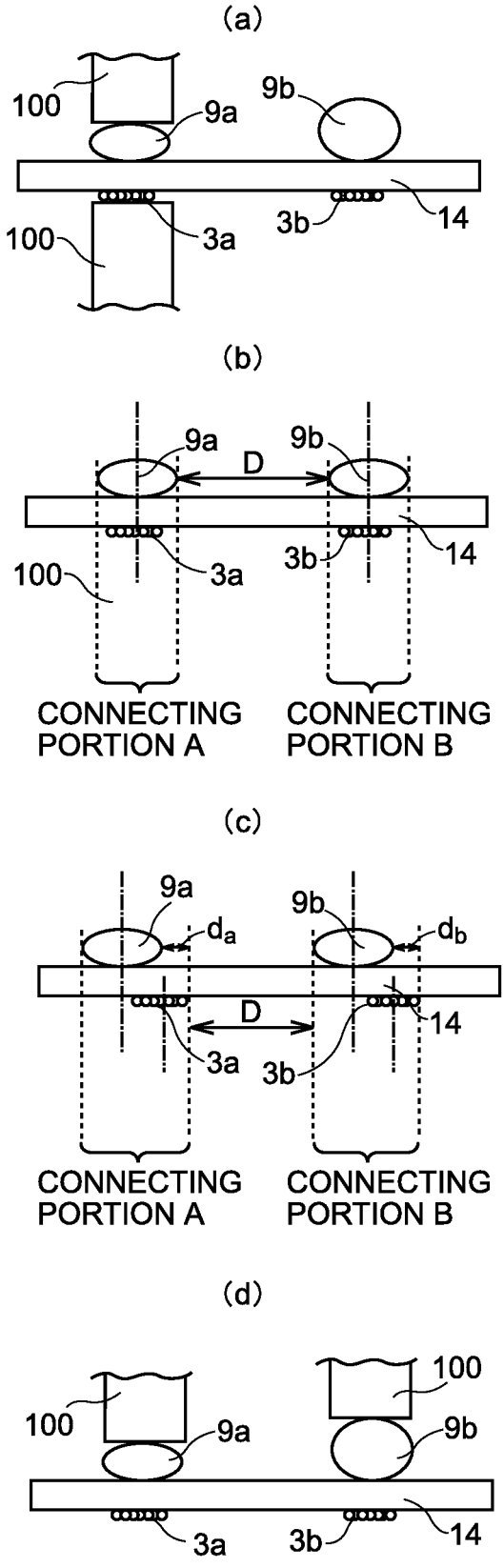
FIG. 7 is an explanatory drawing explaining "process 4" of a method of producing a pressure-sensitive sensor 1 according to embodiment 1.

Next, as shown in FIG. 7(*a*), after the lead wires 9*a* and 9*b* have been disposed on the bottom surface of the metal plate, two electrodes 100 sandwich one lead wire 9*a* out of lead wires 9*a* and 9*b*, a twisted copper wire 3*a*, and a metal plate 14, and electric current is applied to the lead wire 9*a*, twisted copper wire 3*a* and the metal plate 14. At this point, in the same manner as process 3, by generating Joule heat on the metal plate 14 which is a welding target base, twisted copper wire 3*a*, and the lead wire 9*a* due to electric current running from the electrodes 100, and melting tin that has been plated on the metal plate 14, and simultaneously applying a pressing force vertically by the two electrodes 100, the lead wire 9*a* and the metal plate 14 are welded together to make a connection. The pressure for resistance welding is 98 N, and the current-carrying condition is 2.3 kA, 13 ms. Then, the same resistance welding is applied to the other lead wire 9*b*. Eventually in this process, a configuration is formed wherein two twisted copper wires 3*a* and 3*b* of the cable 11 for the pressure-sensitive sensor are connected to the top surface of one metal plate 14, and lead wires 9*a* and 9*b* extending from both ends of the resistor body 8 are connected to the bottom surface of the metal plate 14 (hereafter, referred to as prior-to-separation pressure-sensitive sensor 1).

Moreover, in this embodiment, as shown in FIG. 7(*b*), lead wires 9*a* and 9*b* are disposed at locations where the median line of the width of the lead wires 9*a* and 9*b* matches the median line of the width of the twisted copper wires 3*a* and 3*b*; however, as shown in FIG. 7(*c*), it is not always necessary to dispose the lead wires 9*a* and 9*b* at locations where the median line of the width of the lead wires 9*a* and 9*b* almost matches the median line of the width of the twisted copper wires 3*a* and 3*b*. In this case, as shown in FIG. 7(*c*), the width of the connecting portion A and the width of the connecting portion B can be expressed by the width of the lead wire 9*a*+width da and the width of the lead wire 9*b*+width db, respectively. Herein, width da, db mean in FIG. 7(*c*) the width of the portions in which lead wires 9*a* and 9*b* and twisted copper wires 3*a* and 3*b* are not superposed via the metal plate 14.

Furthermore, in this process, two electrodes 100 vertically sandwich one lead wire 9*a* out of lead wires 9*a* and 9*b*, a twisted copper wire 3*a*, and a metal plate 14 and resistance welding is conducted; however, in the same manner as process 3, for example, as shown in FIG. 7(*d*), it is possible to conduct resistance welding while one electrode 100 is made to come in contact with the lead wire 9*a*, and the other electrode 100 is apposed to the electrode 100 in the direction of the width of the metal plate 14 (horizontal direction in FIG. 7(*d*)) and made to come in contact with the lead wire 9*b*. In this case, lead wires 9*a* and 9*b* can be simultaneously resistance-welded.

(Process 5: Separation Process)

Next, process 5 for separating connecting portions A and B between the twisted copper wires 3*a* and 3*b* and the lead wires 9*a* and 9*b* will be described with reference to FIG. 8.

Figure 8:
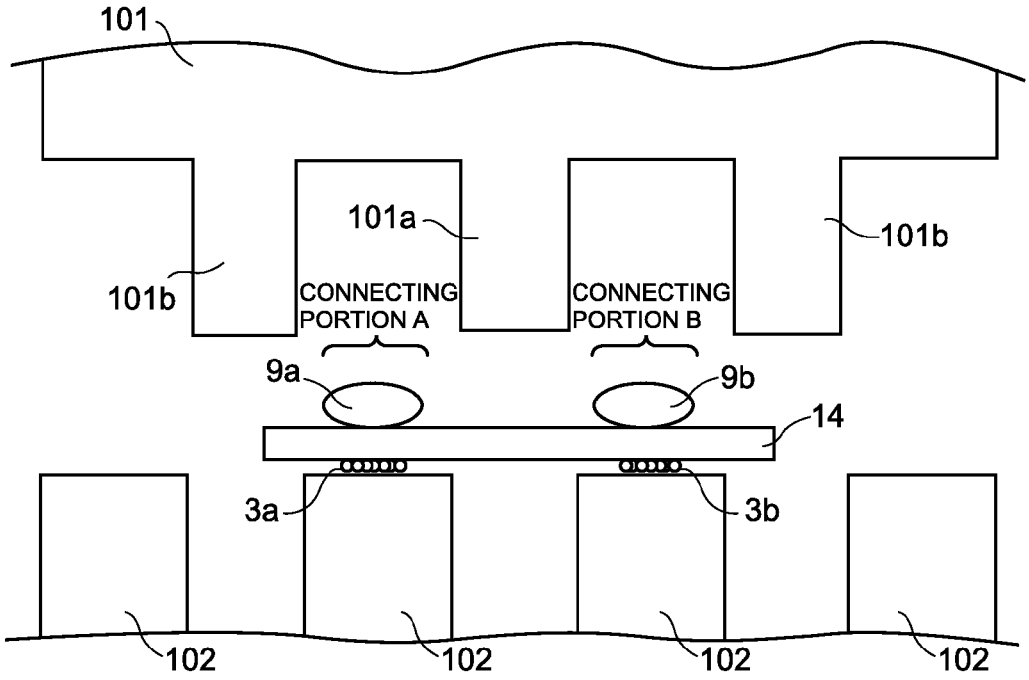
FIG. 8 is an explanatory drawing explaining "process 5" for separating connecting portions A and B.
Figure 8:
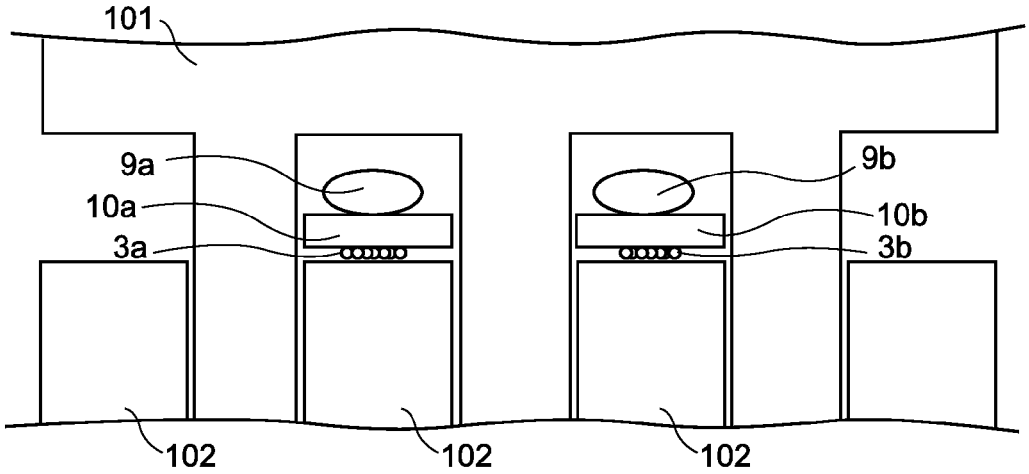

First, as shown in FIG. 8(*a*), the end portion of the prior-to-separation pressure-sensitive sensor 1 formed through the above processes is disposed on two lower-part dies 102 for cutting having the same height that are placed at a predetermined interval. At this point, connecting portion A that connects together the twisted copper wire 3*a* and the lead wire 9*a* and connecting portion B that connects together the twisted copper wire 3*b* and the lead wire 9*b* are placed on the respective lower-part dies 102 for cutting. The predetermined interval between the two lower-part dies 102 for cutting should be almost identical to the distance between the connecting portion A that connects together the twisted copper wire 3*a* and the lead wire 9*a* and the connecting portion B that connects together the twisted copper wire 3*b* and the lead wire 9*b* and simultaneously greater than the width of the inter-connecting-portion cutting portion 101*a* of an upper-part die 101 for cutting which will be described later. After the end portion of the prior-to-separation pressure-sensitive sensor 1 has been disposed on such lower-part dies 102 for cutting, by moving the upper-part die 101 for cutting from the top to the bottom in the end portion of the prior-to-separation pressure-sensitive sensor 1 placed on the lower-part dies 102 for cutting, the metal plate 14 between the connecting portion A and the connecting portion B is cut, thereby the connecting portion A and the connecting portion B are separated (see FIG. 8(*b*)). At this point, when the metal plate 14 between connecting portion A and connecting portion B was cut and the connecting portion A and the connecting portion B were separated, the metal plate that mediates connections between the twisted copper wires 3*a* and 3*b* and the lead wires 9*a* and 9*b* becomes the above-mentioned metal terminals 10*a* and 10*b*.

Moreover, the cutting die 101 used in this process can be any cutting die having an inter-connecting-portion cutting portion 101*a* that can cut only a portion between the connecting portions; however, as shown in FIG. 8, it is also possible to provide another cutting portion 101*b* for the upper-part die for cutting so that excess portions other than the connecting portions A and B on the metal plate 14 can be cut.

Figure 9:
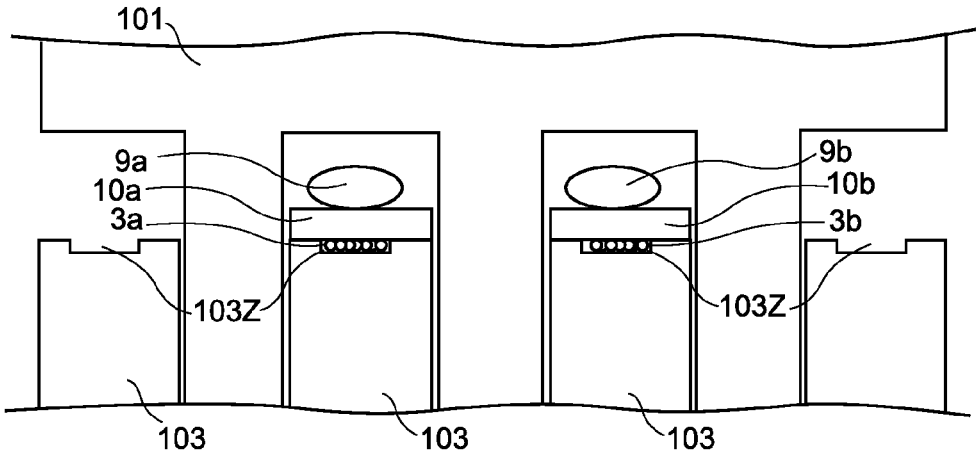
FIG. 9 is an explanatory drawing explaining the method of producing a pressure-sensitive sensor 1 according to embodiment 1 when a lower-part die for cutting 103 having a counterbored portion 103Z is used.
Figure 10:
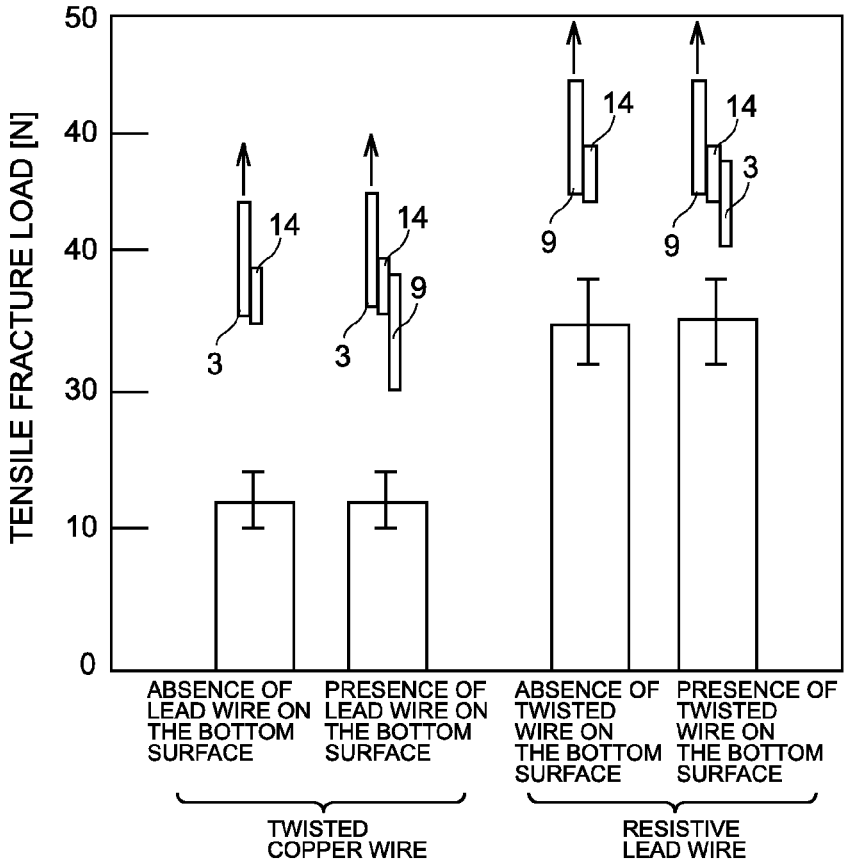
FIG. 10 is a drawing showing the result of the tensile test for connecting portions A and B according to embodiment 1 of the present invention.

Furthermore, the lower-part die for cutting 102 used in this process has a flat surface as shown in FIG. 8; however, it is possible to use lower-part dies for cutting 103 each having a concave counterbored portion 103Z at a location that corresponds to the twisted copper wire 3*a* and 3*b* or the lead wire 9*a* and 9*b* as shown in FIG. 9. By the use of such lower-part dies 103 for cutting, when conducting this process, it is possible to facilitate the positioning when placing the end portion of the prior-to-separation pressure-sensitive sensor; accordingly, it is possible to increase positional accuracy of the cutting position and simultaneously reduce an opportunity of mistakenly cutting the connecting portions A and B. Moreover, the cutting process in this process can be conducted by means of a laser beam, diamond cutter, or the like, instead of using the upper-part die 101 for cutting or lower-part dies 102 for cutting.

(Process 6: Process for Resinating the End Portion)

Next, the process for resinating the end portion of the pressure-sensitive sensor 1 will be described.

The pressure-sensitive sensor 1, shown in FIG. 2, wherein the resistive element 7 is connected to the terminal portion of the cable 11 for the pressure-sensitive sensor is, in this embodiment, as shown in FIG. 2, wrapped around with a transparent resin sleeve 25; and after ultraviolet curable insulating resin 26 has been injected from the opening thereof, the pressure-sensitive sensor 1 cures in a short amount of time (the range between 1 second and 30 minutes) by ultraviolet light that passes through the sleeve 25, thereby being sealed. However, the process for resinating the end portion of the pressure-sensitive sensor 1 is not limited to this, and the previously described resinating process can also be applied.

Thus, the above-mentioned pressure-sensitive sensor 1 is produced by the method of producing a pressure-sensitive sensor 1 wherein the above-mentioned two twisted copper wires 3*a* and 3*b* are connected to one surface (top surface) of the metal plate 14, and lead wires 9*a* and 9*b* extending from both ends of the resistor body 8 are connected to the other surface (bottom surface). Moreover, when conducting this production method, there was a concern that connection strength may decrease because welding is conducted in two processes at locations where the twisted copper wires 3 and the resistive element's lead wires 9 are superposed on both the top and bottom surfaces of the metal terminal 3; however, by optimizing welding conditions, the tensile fracture load was almost the same as that in the tensile test in the situation where the twisted copper wires 3*a* and 3*b* and the resistive element's lead wires 9 are respectively welded to the metal terminal 14 (see FIG. 10).

<Function Effect of Embodiment 1>

(1) According to this embodiment, electrode wires 2*a* and 2*b* (twisted copper wires 3*a* and 3*b* in this embodiment) and lead wires 9*a* and 9*b* are not directly connected, but the electrode wires 2*a* and 2*b* and the lead wires 9*a* and 9*b* are connected via a metal plate 14 having a certain width, and then connecting portions A and B between the electrode wires 2*a* and 2*b* and the lead wires 9*a* and 9*b* are separated; therefore, strict position adjustment is not necessary and making electrical connections between the electrode wire 3*a* and 3*b* and the lead wires 9*a* and 9*b* is facilitated; accordingly, it becomes easy to produce a pressure-sensitive sensor 1 having two electrode wires to contribute to reducing costs and the size. Furthermore, in this embodiment, when connecting the twisted copper wires 3*a* and 3*b* and the lead wires 9*a* and 9*b* via a metal plate 14, welding is conducted by sandwiching those wires between the electrodes 100 via the metal plate 14 and applying electric current; therefore, there is no need for the space to appose the two electrodes 100 in a longitudinal direction of the pressure-sensitive sensor 1 as described in patent literature 4; thus, it is possible to inhibit the increase in size of the end portion of the pressure-sensitive sensor 1 having two electrode wires to contribute to reducing costs and the size. Accordingly, it is possible to contribute to the inhibition of the increase in size of the non-pressure-sensitive portion of the pressure-sensitive sensor 1.

(2) When directly connecting twisted copper wires 3*a* and 3*b* and lead wires 9*a* and 9*b*, the welding condition tends to fluctuate due to unstable position adjustment and fluctuation of contact resistance; however, according to the present invention, by making connections via a metal plate 14, there is an advantage that the area of connection and the connection strength become stable.

<Variations of Embodiment 1>

A method of producing a pressure-sensitive sensor 1 according to embodiment 1 of the present invention is not limited to the above-mentioned method, but variations are possible as described below. Hereafter, variations of the method of producing a pressure-sensitive sensor 1 according to embodiment 1 of the present invention will be described in detail.

(Variation 1)

With regard to variation 1 of embodiment 1, a description will be given below with reference to FIG. 11.

Figure 11:
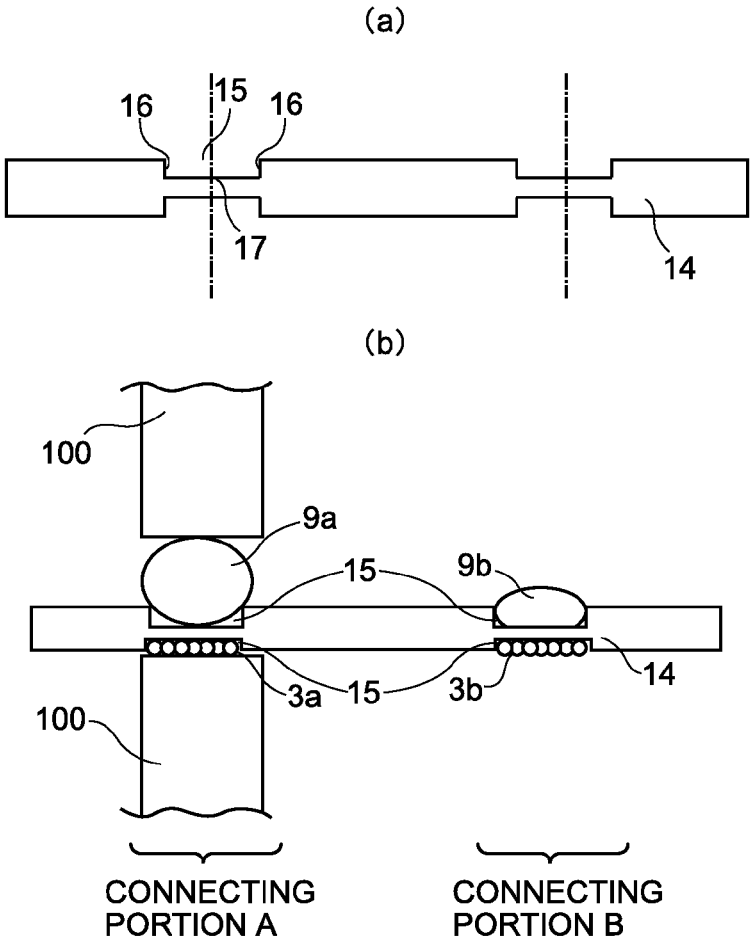
FIG. 11 is an explanatory drawing explaining the method of producing a pressure-sensitive sensor 1 according to variation 1 of an embodiment wherein a counterbored portion 15 is provided on the metal plate 14.

In the above-mentioned embodiment 1, during the above-mentioned "process 3" and "process 4", the twisted copper wires 3 and the lead wires 9 are connected to the metal plate 14 having flat top and bottom surfaces; however, as variation 1, as shown in FIG. 11(*a*), the twisted copper wires 3 and the lead wires 9 may be connected to the metal plate 14 having top and bottom surfaces each provided with a concave counterbored portion 15. The concave counterbored portion 15 facilitates the positioning when the twisted copper wires 3 and the lead wires 9 are placed on the metal plate 14 to make connections. Furthermore, when electrodes 100 for welding are made to come in contact with the twisted copper wires 3 and the metal plate 14 when welding, it is possible to reduce positional deviation. Accordingly, it is possible to minimize connecting portions A and B between the twisted copper wires 3*a* and 3*b* and the lead wires 9*a* and 9*b* (see FIG. 11(*b*)). Moreover, it is possible to reduce the scatter of the twisted copper wires 3 by placing the twisted copper wires 3 in the counterbored portions 15 when welding. Furthermore, by placing the twisted copper wires 3 and the lead wires 9 in the counterbored portion 15 and conducting resistance welding, the twisted copper wires 3 and the lead wires 9 come in contact with two vertical surfaces 16 and one horizontal surface 17 of the counterbored portion 15 to make connections, which makes it possible to increase the connection strength. That is, the counterbored portion 15 has a function to contribute to facilitating the positioning, a function to reduce the positional deviation when welding, a function to reduce the scatter of the twisted copper wires 9, and a function to increase the strength of the connections between the twisted copper wires 3 and the lead wires 9.

The counterbored portion 15 can be formed, for example, by cutting or pressing by the use of a convex-shape die.

Moreover, it is preferable that the counterbored portion 15 formed on the top surface be made so that the median line of the width of the counterbored portion 15 formed on the top surface almost matches the median line of the width of the counterbored portion 15 formed on the bottom surface. By doing so, when connecting twisted copper wires 3*a* and 3*b* and lead wires 9*a* and 9*b* via a metal plate 14, it is possible to easily place the twisted copper wires 3*a* and 3*b* and the lead wires 9*a* and 9*b* at locations where the median line of the width of the lead wires 9*a* and 9*b* and the median line of the width of the twisted copper wires 3*a* and 3*b* is superposed in order to prevent the increase in size of the non-pressure-sensitive portion of the pressure-sensitive sensor 1.

(Variation 2)

With regard to variation 2 of embodiment 1, a description will be given below with reference to FIG. 12 and FIG. 13.

Figure 12:
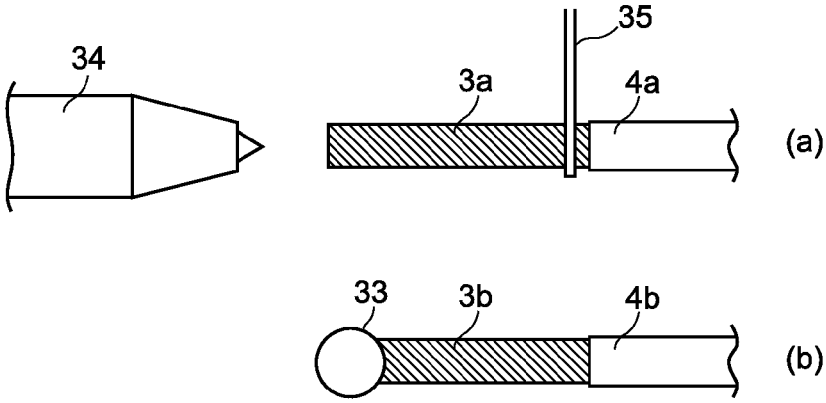
FIG. 12 is a process chart for wiring fixation of the terminal of the twisted copper wire in variation 2 of an embodiment 1 of the present invention.
Figure 13:
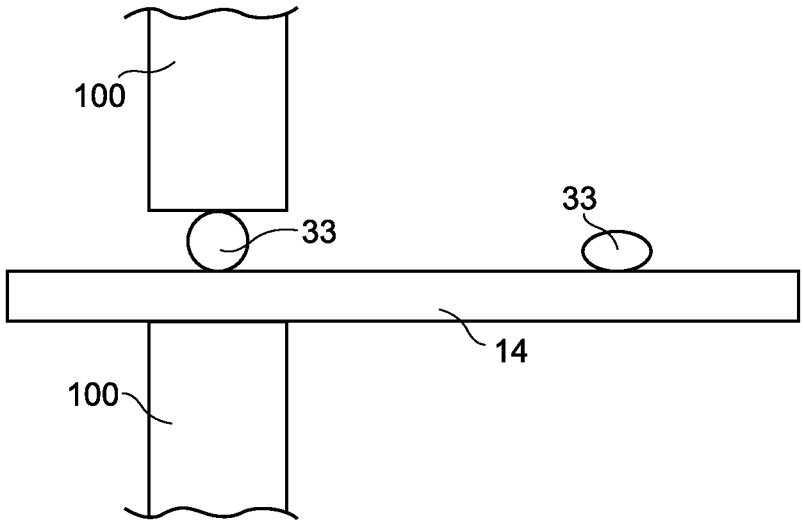
FIG. 13 is a drawing showing the resistance welding of the fixed twisted copper wires to the metal plate in variation 2 of an embodiment 1 of the present invention.

With reference to FIG. 12 and FIG. 13, a method of connecting the terminal of the twisted wire to the metal terminal after the terminal of the twisted wire has been fixed.

FIG. 12 is a process chart for the fixation of the terminal of the twisted copper wires 3. By fixing the terminal, it is possible to reduce the risk of short-circuits between the twisted wires due to the scattered twisted copper wires 3. Hereafter, the method will be described.

As shown in FIG. 12, an earth plate 35 is made to come in contact with predetermined locations of the twisted copper wires 3*a* and 3*b*, and the torch 34 of the arc welding machine is made to approach the tip of the twisted copper wires 3*a* and 3*b*. When generating arc between the tip of the torch 34 and the tip of the twisted copper wires 3*a* and 3*b*, the tip portion of the twisted copper wires 3*a* and 3*b* is melted, thereby forming a molten sphere 33 of the twisted copper wires, as shown in FIG. 12, due to surface tension.

FIG. 13 shows the situation in which the fixed twisted copper wires 3*a* and 3*b* are resistance welded to the metal plate 14. Since the molten spheres 33 of the fixed twisted copper wires 3*a* and 3*b* come in point contact with the welding electrode 100 and the metal plate 14, when compared with the case in which direct welding is conducted without performing wiring fixation, current density increases, the area of contact becomes constant, and by stabilizing resistance welding, more accurate welding can be conducted.

(Variation 3)

With regard to variation 3 of embodiment 1, a description will be given below with reference to FIGS. 14 to 16.

Figure 14:
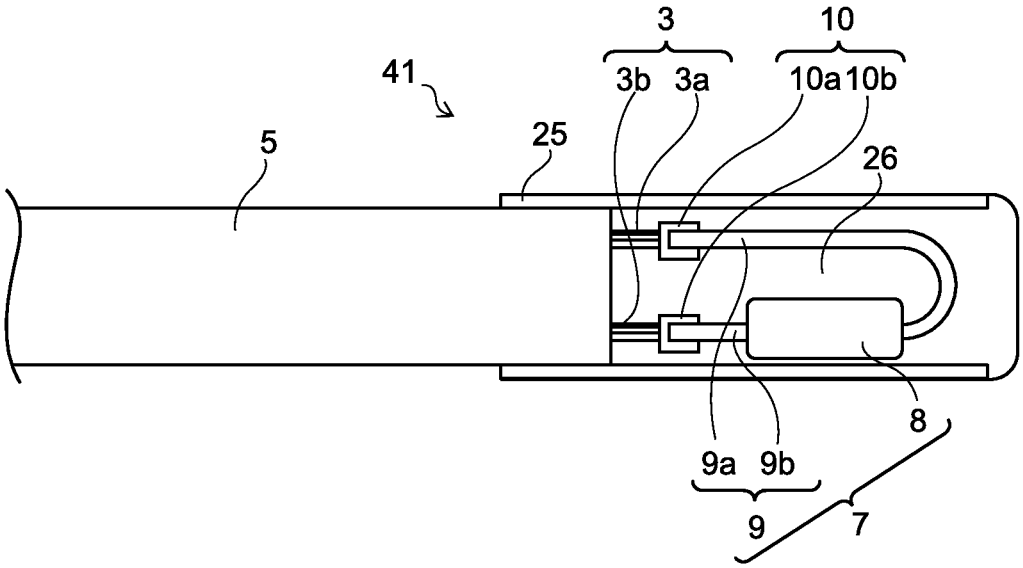
FIG. 14 is a longitudinal sectional view of the terminal portion of the pressure-sensitive sensor 31 according to variation 3 of an embodiment 1 of the present invention.

FIG. 14 is a vertical end view of the terminal portion of the pressure-sensitive sensor 41 according to variation 3. FIG. 15(*a*) shows a cross-sectional view and a perspective view with regard to the method in which twisted copper wires 3 and lead wires 9 are butted one another on the metal plate 14 and then connected by resistance welding. FIG. 15(*b*) shows a cross-sectional view and a perspective view with regard to the method in which twisted copper wires 3 and lead wires 9 are butted one another by the use of a metal plate 14 having counterbored portions provided on the surface thereof to place the twisted copper wires 3 and the lead wires 9, and then those wires are connected by resistance welding. FIG. 15(*c*) shows a cross-sectional view and a perspective view with regard to the method in which a level-difference portion 18 is provided on the metal plate 14 provided with the counterbored portions, and the depth and the width of both counterbored portions are changed, and then the twisted copper wires 3 and the lead wires 9 are superposed and connected by resistance welding. The numbers 91 and 92 shown in FIG. 15(*b*) and FIG. 15(*c*) are the counterbored portion for placing the twisted copper wires and the counterbored portion for placing the lead wires, respectively.

Figure 16:
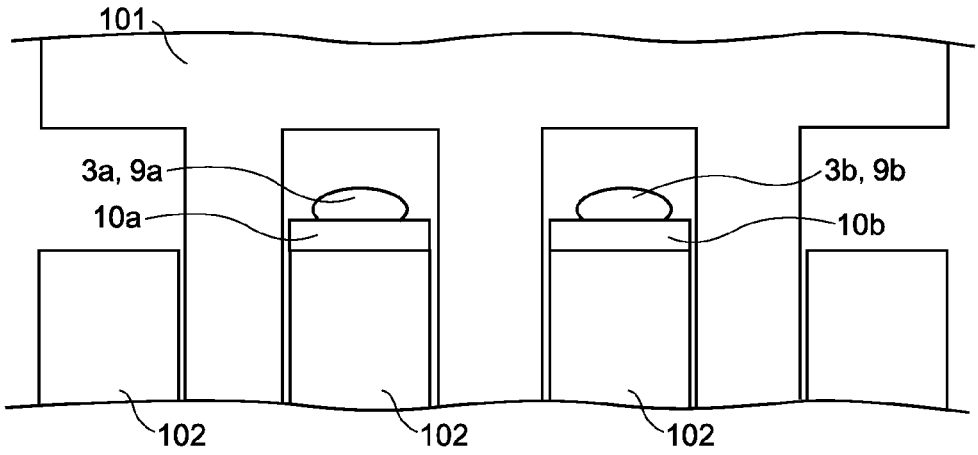
FIG. 16 is a cross-sectional view showing the separation process in variation 3 of an embodiment of the present invention.
Figure 17:
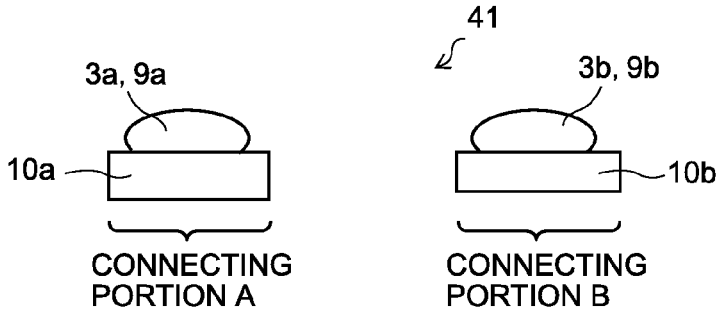
FIG. 17 is a drawing showing connecting portions A and B that have been separated in the pressure-sensitive sensor 41 according to variation 3 of an embodiment of the present invention.

While in the pressure-sensitive sensor 1 according to embodiment 1, twisted copper wires 3*a* and 3*b* and lead wires 9*a* and 9*b* are connected to the top surface and the bottom surface of the metal plate 14, respectively (see FIG. 1 and FIG. 2), in the pressure-sensitive sensor 41 according to variation 3, as shown in FIG. 14, the twisted copper wires 3*a* and 3*b* and the lead wires 9*a* and 9*b* are connected to one surface: either the top surface or the bottom surface of the metal plate 14. In the method of producing a pressure-sensitive sensor 41 according to variation 3, as shown in FIG. 15(*a*), to minimize the space in the horizontal direction (diagonally vertical right direction in FIG. 15(*a*)) of the connecting portions A and B between the twisted copper wires 3*a* and 3*b* and the lead wires 9*a* and 9*b*, the twisted copper wires 3*a* and 3*b* and the lead wires 9*a* and 9*b* are butted one another on the metal plate 14. However, to minimize the space in the vertical direction (the horizontal direction in FIG. 15(*a*)), it is also possible to appose the twisted copper wires 3 and the lead wires 9 instead of butting the twisted copper wires 3 and the lead wires 9 on the metal plate 14. And, after the above-mentioned arrangement has been completed, an electrode 100 for resistance welding is made to come in contact with both the twisted copper wires 3 and the lead wires 9 from above, and then another electrode 100 for resistance welding is made to come in contact with the metal plate 14 from the bottom so that the twisted copper wires 3, lead wires 9, and the metal plate 14 are sandwiched between the electrodes. Subsequently, electric current is applied between the two electrodes 100 for resistance welding, and the twisted copper wires 3 and the lead wires 9 are resistance welded to the metal plate 14 under the same resistance welding conditions as the above-mentioned embodiment 1. Then, by conducting the separation process shown in FIG. 16, the pressure-sensitive sensor 41 as shown in FIG. 17 will be completed. In the pressure-sensitive sensor 41 shown in FIG. 17, the twisted copper wire 3*a* and the lead wire 9*a* and the twisted copper wire 3*b* and the lead wire 9*b* are connected together to one surface of the metal terminals 10*a* and 10*b* and connecting portions A and B are provided, respectively. By the use of such a production method, during the separation process, separation can be conducted while looking at the connecting portions A and B between the twisted copper wires 3*a* and 3*b* and the lead wires 9*a* and 9*b*; therefore, it is possible to reduce the opportunity of mistakenly cutting the connecting portions A and B between the twisted copper wires 3*a* and 3*b* and the lead wires 9*a* and 9*b*.

Figure 15:
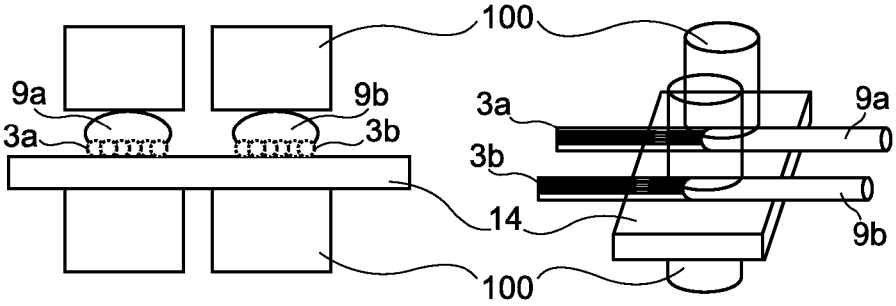
FIG. 15 is an explanatory drawing explaining the resistance welding process for welding together the twisted copper wires and the lead wires according to variation 3 of an embodiment 1 of the present invention.
Figure 15:
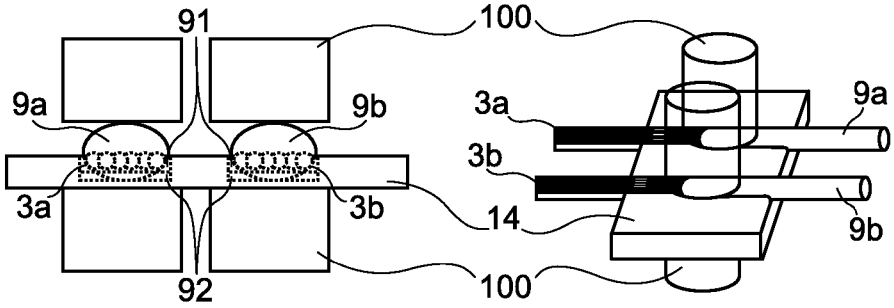
Figure 15:
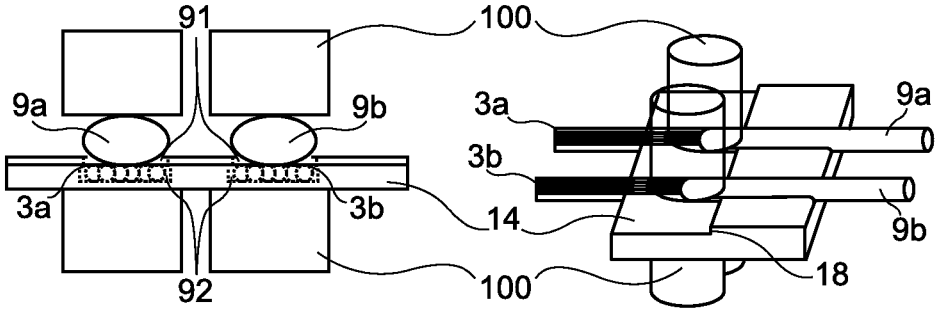

Furthermore, in this variation, counterbored portions 91 and 92 for positioning the twisted copper wires 3*a* and 3*b* and the lead wires 9*a* and 9*b* may be formed on either the top surface or the bottom surface of the metal plate 14 (see FIG. 15(*b*) and (*c*)). These counterbored portions 91 and 92 exert the same effect as that of the counterbored portions 15 in embodiment 1 shown in FIG. 11. In this variation, with regard to these counterbored portions 91 and 92, to adjust the butting position between the twisted copper wires 3*a* and 3*b* and the lead wires 9*a* and 9*b* as shown in FIG. 15(*b*), the depth of the counterbored portion 91 in which the twisted copper wires 3*a* and 3*b* are disposed and the depth of the counterbored portion 92 in which the lead wires 9*a* and 9*b* are disposed may be changed; or as shown in FIG. 15(*c*), a level-difference portion 18 may be provided to dispose the twisted copper wires 3*a* and 3*b* and the lead wires 9*a* and 9*b* so that they superpose one another.

Embodiment 2

A Method of Producing the Pressure-Sensitive Sensor 1 Wherein Laser Welding is Used The method of connecting the end portion of the pressure-sensitive sensor by means of laser welding will be described with reference to FIG. 18 and FIG. 19.

In this embodiment, connections between twisted copper wires 3 and lead wires 9 are made by laser welding instead of resistance welding. As a laser light source, for example, a YAG laser, a semiconductor laser, or the like, can be used.

Figure 18:
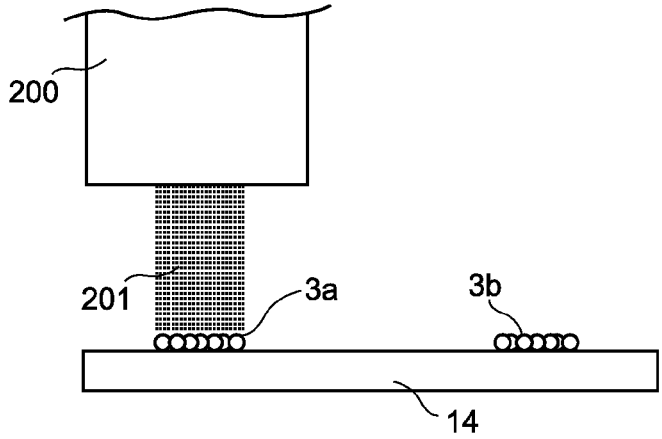
FIG. 18 is a drawing showing the laser welding process for connecting the twisted copper wires to the metal terminal by irradiation of a laser in embodiment 2 of the present invention.
Figure 19:
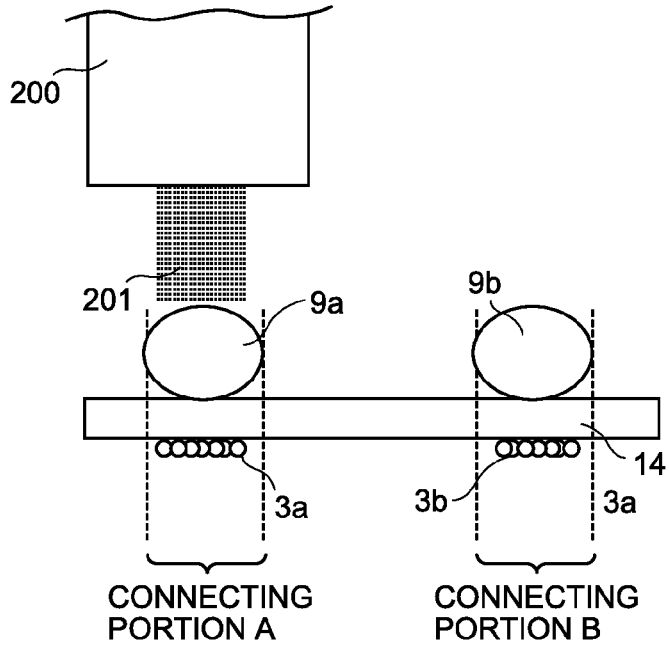
FIG. 19 is a drawing showing the laser welding process for connecting the resistive element's lead wires to the metal terminal by irradiation of a laser in embodiment 2 of the present invention.

FIG. 18 shows the situation in which twisted copper wires 3 are placed on the metal plate 14, and a laser beam 201 of the YAG laser is irradiated from the laser head 200 while tension is applied to the twisted copper wires 3. Similarly, FIG. 19 shows the situation in which lead wires 9 are connected to the bottom side of the metal plate 14 by laser welding.

Figure 6:
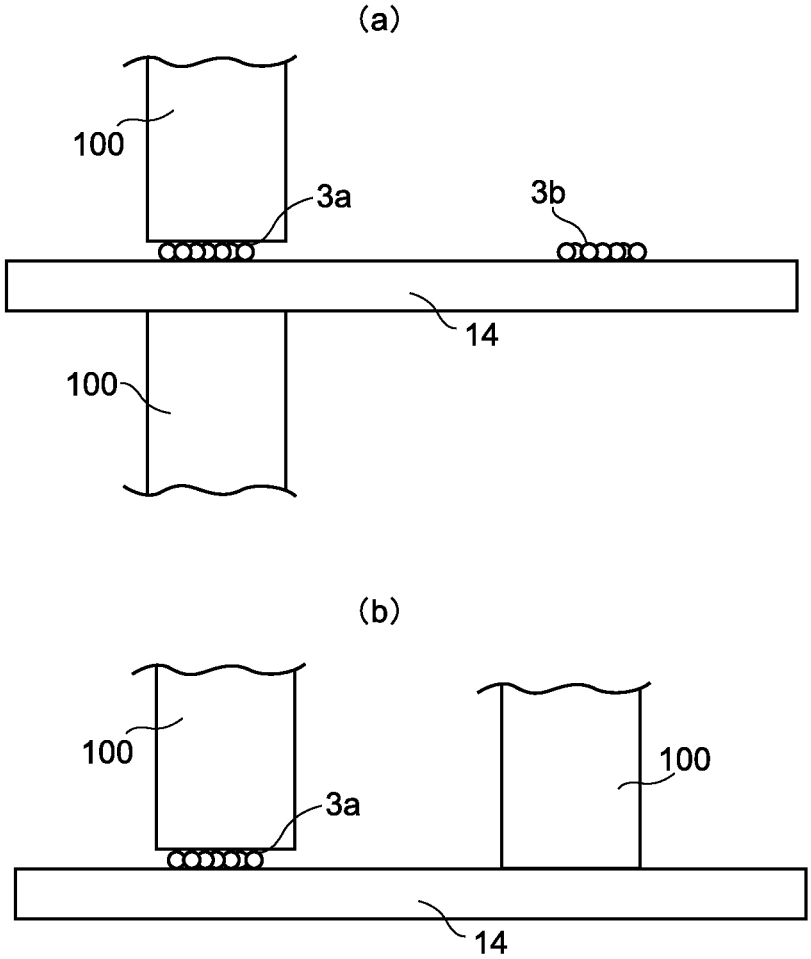
FIG. 6 is an explanatory drawing explaining "process 3" of a method of producing a pressure-sensitive sensor 1 according to embodiment 1.

In the case of resistance welding, making the diameter of electrodes 100 shown in FIG. 6 and FIG. 7 greater than the width of the welding member of the twisted copper wires and the lead wires is advantageous in terms of stability of welding and long service life; however, due to mutual interference of the electrodes 100, limitation in the size of the weldable portion may occur. On the other hand, in the case of laser welding, if there is no obstacle all the way to the welding portion, welding a smaller portion is possible.

Figure 20:
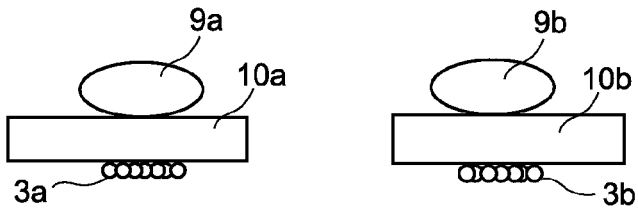
FIG. 20 is a drawing showing the connecting portions of the pressure-sensitive sensor according to embodiment 2 of the present invention.

By connecting twisted copper wires 3 and lead wires 9 to the metal plate 14 by means of laser welding and then cutting the connecting portions A and B and the outer excess portion, the metal plate 14 is separated into two metal terminals 10*a* and 10*b* as shown in FIG. 20; thus, the connecting portions of the pressure-sensitive sensor in which the twisted copper wires 3*a* and 3*b* and the resistive lead wires 9*a* and 9*b* are connected via the metal terminals 10*a* and 10*b* are obtained.

The invention claimed is:

1. A pressure-sensitive sensor production method, comprising:

exposing first and second electrode wires longitudinally provided along the inner surface of an elastic insulating member having a hollow;

forming a resistive element into a U-letter shape, the resistive element comprising a resistor body and first and second lead wires extending from respective ends of the resistor body;

electrically connecting said first and second electrode wires exposed from said elastic insulating member and said first and second lead wires extending from both ends of said resistor body via one metal plate; and cutting the one metal plate into a first metal plate portion via which said first electrode wire and said first lead wire are electrically connected, and a second metal plate portion via which said second electrode wire and said second lead wire are electrically connected.

2. The pressure-sensitive sensor production method according to claim 1, wherein:

said two electrode wires are provided on the inner surface of said elastic insulating member in a double-helical manner.

3. The pressure-sensitive sensor production method according to claim 1, wherein:

when connecting said electrode wires and said resistive element's lead wires to said one metal plate, said electrode wires and said resistive element's lead wires are connected to the top surface and the bottom surface of said one metal plate, respectively.

4. The pressure-sensitive sensor production method according to claim 2, wherein:

when connecting said electrode wires and said resistive element's lead wires to said one metal plate, said electrode wires and said resistive element's lead wires are connected to the top surface and the bottom surface of said one metal plate, respectively.

5. The pressure-sensitive sensor production method according to claim 1, wherein:

the electrical connection of said first electrode wire and said first lead wire and the electrical connection of said second electrode wire and said second lead wire are separated by an interval between 1 and 3 mm.

6. The pressure-sensitive sensor production method according to claim 2, wherein:

the electrical connection of said first electrode wire and said first lead wire and the electrical connection of said second electrode wire and said second lead wire are separated by an interval between 1 and 3 mm.

7. The pressure-sensitive sensor production method according to claim 1, wherein:

said first and second electrode wires each comprise a twisted copper wire and a conductive rubber covering the outer circumference of the twisted copper wire.

8. The pressure-sensitive sensor production method according to claim 1, wherein:

said first and second lead wires each comprise a copper wire, and said one metal plate comprises a copper alloy.

9. The pressure-sensitive sensor production method according to claim 1, wherein:

said first and second electrode wires and said first and second lead wires are electrically connected to said one metal plate by resistance welding or laser welding.

10. The pressure-sensitive sensor production method according to claim 9, wherein:

said first and second electrode wires and said first and second lead wires are electrically connected to said one metal plate by resistance welding using electrodes that vertically sandwich said first and second electrode wires, said first and second lead wires, and said one metal plate.

11. A pressure-sensitive sensor, comprising:

an elastic insulating member having a hollow portion;

first and second electrode wires longitudinally provided along the inner surface of said elastic insulating member;

first and second metal terminals to which said first and second electrode wires are connected respectively, said first and second metal terminals being of one metal plate separated spatially and electrically; and a resistive element having a resistor body and first and second lead wires extending from both ends of the resistor body and connected to said first and second metal terminals respectively, said resistive element being formed into a U-letter shape.

12. The pressure-sensitive sensor according to claim 9, wherein:

said first and second electrode wires are provided in a double-helical manner.

13. The pressure-sensitive sensor according to, claim 11 wherein:

said first and second electrode wires and said resistive element's first and second lead wires are connected to the top surface and the bottom surface of said first and second metal terminals respectively.

14. The pressure-sensitive sensor according to claim 12, wherein:

said first and second electrode wires and said resistive element's first and second lead wires are connected to the top surface and the bottom surface of said first and second metal terminals respectively.

15. The pressure-sensitive sensor according to claim 11, wherein:

an interval between said first and second metal terminals is between 1 and 3 mm.

16. The pressure-sensitive sensor according to claim 12, wherein:

an interval between said first and second metal terminals is between 1 and 3 mm.

17. The pressure-sensitive sensor according to claim 11, wherein:

said first and second electrode wires each comprise a twisted copper wire and a conductive rubber covering the outer circumference of the twisted copper wire.

18. The pressure-sensitive sensor according to claim 11, wherein:

said first and second lead wires each comprise a copper wire, and said first and second metal terminals comprise a copper alloy.

19. The pressure-sensitive sensor according to claim 11, wherein:

said first and second electrode wires and said resistive element's first and second lead wires are connected to said first and second metal terminals resistance welding or laser welding.

20. The pressure-sensitive sensor according to claim 11, further comprising:

an insulating spacer being provided between said resistive element's first and second lead wires.

* * * * *